United States Patent [19]

Nelkin

[11] 4,224,931

[45] Sep. 30, 1980

[54] VIBRATING APPARATUS

[76] Inventor: Leon Nelkin, 8515 Ariel, Houston, Tex. 77074

[21] Appl. No.: 915,243

[22] Filed: Jun. 13, 1978

[51] Int. Cl.[3] ..... A61H 1/00

[52] U.S. Cl. ..... 128/32; 128/36; 128/33

[58] Field of Search ..... 128/32–36

[56] References Cited

U.S. PATENT DOCUMENTS

| | | | |
|---|---|---|---|
| 864,528 | 8/1907 | Fuchs | 128/36 |
| 2,425,655 | 8/1947 | Tompkins | 128/33 |
| 3,489,139 | 1/1970 | Rowe | 128/36 |
| 3,799,154 | 3/1974 | Knop | 128/36 |
| 4,006,739 | 2/1977 | Wahl | 128/33 |

*Primary Examiner*—Lawrence W. Trapp

*Attorney, Agent, or Firm*—Bernard A. Reiter

[57] ABSTRACT

A vibrating apparatus comprising a pair of arms supported each in cantilever manner from an off-center vibrating motor and disposed in separate but substantially parallel planes, said arms being in structural communication at their free ends and configured to each transmit to the other a vibratory force which is amplified by the receiving arm.

8 Claims, 2 Drawing Figures

VIBRATING APPARATUS

BACKGROUND OF THE INVENTION

Various electrically powered vibrating mechanisms for personal use have been devised and patented in the prior art for muscle massage and personal physical comfort and the like. All are generally characterized by an off-center vibratory motor which is in some manner affixed to an arm or surface which is adapted to receive the vibratory force and which thereafter imparts such force to the person of the user. More particularly, there is commonly known the type of personal vibrating mechanism which is characterized by a surface consisting of a cantilever arm extending from the vibratory motor, which arm commonly is adapted to be inserted beneath the seat of a chair, the mattress of a bed, the back of a lounge chair or the like. These types of devices generally are not used in direct contact with the person of the user but are more generally inserted under the surface of an object, such a a pillow which is in contact with the person of the user. As a consequence, the vibratory force produced by the mechanism is substantially absorbed by the pillow or cushion, or at least is drastically minimized and as a consequence the overall soothing effect which the device is capable of producing is not imparted to the user. A number of factors result in this relatively inefficient utilization of the vibratory amplitude imparted to the arm. One of these is merely the thickness which characterizes the vibrating arm of prior art devices. The thickness of the arm is relatively nominal and the limited vibration amplitude produces little, if any, discernable feeling when the vibratory force is transmitted through a pillow to the person of the user. Also, the limited vibratory amplitude itself is nominal, and as a consequence, independently of the thickness of the arm, there is imparted a relatively small vibratory amplitude through a pillow or cushion to the body of the user.

The improved vibrating apparatus of the invention comprises a device wherein a pair of enlongate arms, each of predetermined cooperating configuration, are fixed in cantilevered manner to an off-center vibrating motor. The arms are connected at their remote end by a clamp, but are disposed in respective planes, vertically removed from one another and wherein the most central part of each cantilever arm diverges from the most central part of the cooperating cantilever arm and wherein the two (2) arms converge towards one another at their ends. The overall configuration of the arms are calculated such that the vibratory force induced to each arm at its attached end produces an outward flexing motion in the corresponding divergent sections of each arm so as to thereby maintain the arms a maximum distance apart at their divergent section and thus avoid absorption of the vibrating amplitude into a cushion or pillow overlying the device. A markedly enhanced vibrating effect is thus felt by the person of the user. Applicant has found that a vibrating mechanism designed in accordance with the principles set forth hereafter produce significantly greater vibrating motion that any equivalent vibrator apparatus of the same motor and arm size.

These and other features and advantages of the invention will become abundantly clear upon reading of the following detailed description, claims and drawings wherein like numerals denote like parts in the several views and wherein:

DETAILED DESCRIPTION OF DRAWINGS

DETAILED DESCRIPTION

Figure 1:
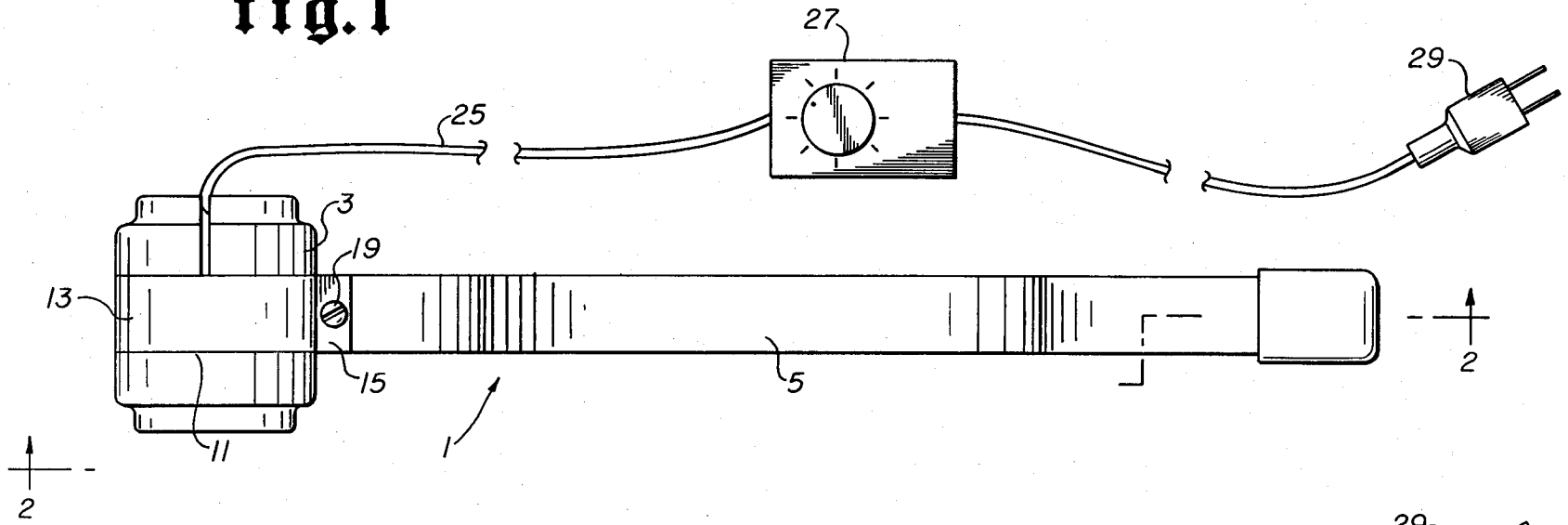
FIG. 1 is a top view of the improved vibrator mechanism of the invention.
Figure 2:
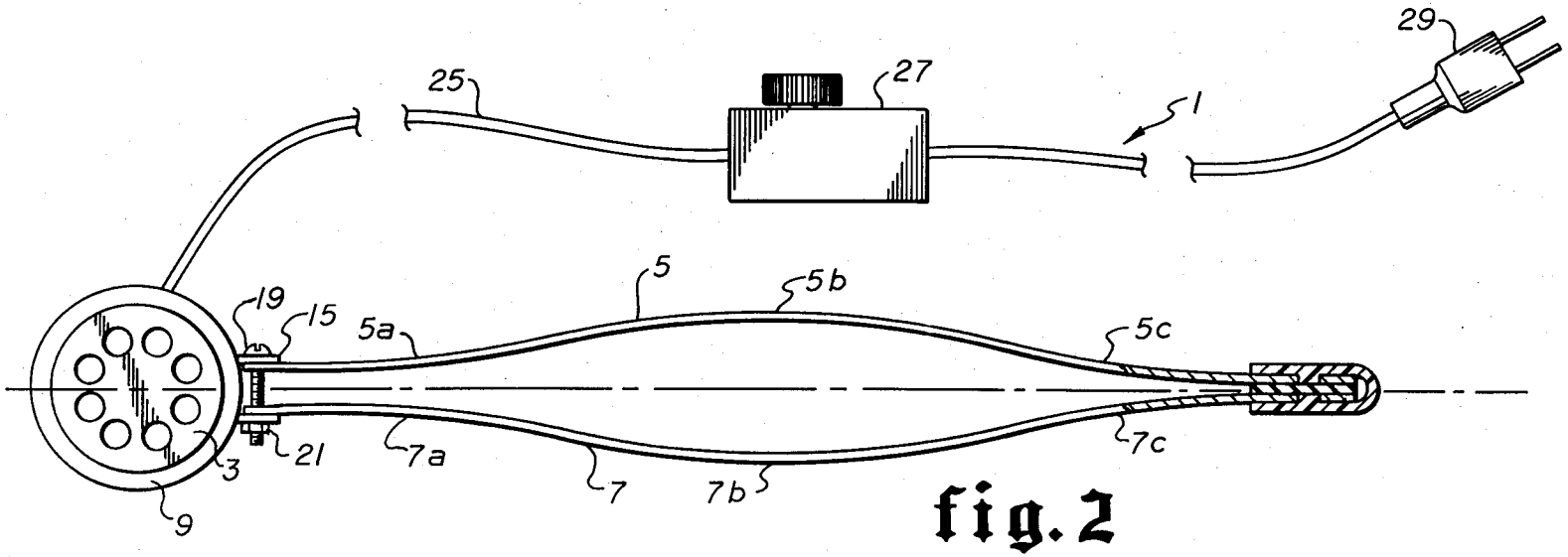
FIG. 2 is an elevation view, along the plane 22 of FIG. 1.

With reference now to the drawings, there is shown the vibrator apparatus 1 comprising an off-center vibratory motor 3 and a pair of arms 5, 7 affixed to the motor and extending in cantilever manner therefrom. The motor housing 9 is characterized by a circumferential recess 11 into which there is fitted the circumferential strap 13 having cooperating flanges 15, 17 for receiving, respectively, the arms 5, 7. Each of the flanges are provided wth an aligned opening, which is similarly aligned with an opening in each of the arms 5, 7 for receiving a threaded screw 19. A lock washer (not shown) or other appropriate means can be used in affixing a nut 21 so as to assemble, in unitary manner the cantilever arms to the motor. An electrical cord 25 communicates from the motor 3 to a conventional timer mechanism 27 and therefrom to an electrical plug 29 which is to be inserted in an outlet.

The cantilever arms are characterized each by an elongate, rigid but flexible body which may be constructed of metal or plastic. The upper arm is characterized by a series of arcuate surfaces. There exists, with respect to the center line, a first arcuate surface which is convex in form and which extends from the initial inward end of the arm 5 to a point preceding the central section. This convex portion is generally illustrated as the arcuate section 5(*a*). A second section exists in concave form, with respect to the center line and tends to diverge therefrom. This concave section 5(*b*) includes the maximum amplitude of the arm with respect to the center line. A third section 5(*c*) is in convex relation with respect to the center line and extends to the cantilever end of the upper arm. The lower arm 7 may be composed of three sections, these being the inner, central and outer portions 7(*a*), 7(*b*) and 7(*c*), each of which respectively are convex, concave and convex with respect to the center line. The amplitude of the arms, in static (resting) state is defined by the linear distance between the apex of sections 5(*b*) and 7(*b*). This amplitude is, of course, at its maximum at the apex of the curves of the arcs 5(*b*), 7(*b*). An amplitude modifying force transmitted along either of the arms will, at some point, be transmitted through the apex section resulting in an oscillating movement, up and down, with respect to the center line. An identical oscillating movement is similarly transmitted through the central section of the opposing arm such that the two sections are always moving with respect to one another. More importantly, however, is the fact that these sections are moving substantially simultaneously in opposing directions because the force that is transmitted to them is transmitted by the rotating motion of the off-center motor 3. Since the armature of the motor rotates past the supported ends of the two arms at its connection to the motor housing at the point denoted by the center line, the force transmitted to the arms is transmitted substantially simultaneously thereto at about the time the motor rotates past the center line position. This imparts a force to the arms which is transmitted outwardly such that it passes the apex point in each arm simultaneously, thus resulting in the outward flexing at those points.

In operation, the force transmitted to the arms from the rotating motor induces a vibrational effect in which the two arms flex outwardly simultaneously, with respect to the center line thus maximizing the vibrating effect. Such a result could not be present in a single vibrating arm because a motor of equivalent size could not vibrate a single arm through the distance defined by the amplitude between the arms 5, 7. Moreover, it is found that the vibrating effect of each arm causes a foreshortening of the length between the inner and outer ends of the arm. When such length is foreshortened by the vibrating effect of one arm, it inherently causes the corresponding cooperating arm to increase its amplitude, since there is nowhere else for the arm to move except upwardly. Thus, each of the two arms cooperate with one another to magnify the overall vibratory effect of the motor and to thus produce an improved vibrating effect, with respect to the motor size used, which is greater than that which may be achieved by other equivalent motors using single cantilever arms.

It will be recognized that numerous modifications may be made to the design of the invention as disclosed herein without departing from the spirit thereof and the scope of the claims appended hereto. For example, it is conceivable that the cooperating vibrating arms may obtain a configuration in which there is more than two convex and one concave section. Likewise, it is feasible, in a modified form, that the vibrating arms consist of a single apex section which defines a given static amplitude, but which may be varied upon introduction of vibrating forces to the arm, so that the dynamic amplitude is greater than the static amplitude.

Therefore, that which is claimed and desired to be secured by United States Letters Patent is:

1. In an improved vibrator apparatus adapted to be installed with an intermediate cushioning surface between the apparatus and the user thereof comprising:

a vibrating motor having electrical connection means extending therefrom for insertion into an electrical socket, first and second rigid arm means affixed to the motor and extending therefrom in cantilever fashion in such manner as to receive and transmit vibratory forces from said motor, said arm means arranged in respective planes separated from each other so that each is free to receive vibratory forces perpendicular to said planes from the motor and to transmit such forces along the length thereof, the vertical distance of said arms from one another being greater intermediate the length thereof than at the ends thereof, so that maximum vibratory effect is transmitted from that section of the arms which is greater distance from the opposing arm than is another section, and connecting means affixing the remote ends of said cantilever arms together so that the vibratory force induced into one arm is transmitted to the other arm so as to cause amplification of the vibration thereof.

2. The vibrating apparatus of claim 1 wherein said first and second arm means includes an upper arm and a lower arm, each said upper arm and lower arm existing in independent, self-supporting relationship to the other arm and with sufficient distance therebetween as to allow vibrational movement of each without contact with the other.

3. The vibrator apparatus of claim 2 wherein said lower arm is adapted to rest upon a supporting surface and said upper arm is adapted to contact the surface intermediate the apparatus and the person of the user, said upper arm being characterized by an elongate configuration when viewed from the top thereof, and being characterized by an arcuate configuration when viewed from the side thereof, said configuration from the side including a central section of concave arc with respect to the lower arm, said central concave arcuate section defining a static amplitude greater than the static amplitude of the arm on either side thereof, so that a vibratory force introduced to the arm at the supported end vibrates over a greater radial arc in the center of the arm than at either end thereof.

4. The vibrating apparatus of claim 3 wherein the lower arm is defined by a configuration which is the mirror image of the upper arm so that vibratory forces introduced to the arms at their supported ends are amplified by the central sections thereof and transmitted toward the unsupported end where such forces are transmitted to the opposing arm.

5. A vibrating apparatus of the type adapted to rest upon a supporting surface and to transmit a vibrational force through a cushioning medium which is in contact with the vibrational apparatus and the person of the user, the vibrational apparatus including a motor attached thereto and residing externally of the cushioning medium and the surface on which the apparatus rests, the improvement comprising:

an upper elongate vibratory arm affixed at one end thereof in cantilever manner to a motor means, an lower elongate vibratory arm affixed at one end thereof in cantilever manner to a motor means, each said arms disposed a vertical distance from one another so as to avoid contact during vibratory motion thereof, the vertical distance of said arms from one another being greater intermediate the length thereof than at the ends thereof, so that maximum vibratory effect is transmitted from that section of the arms which is greater in distance from the opposing arm than is another section.

6. The vibratory apparatus of claim 5 wherein the said upper vibratory arm is characterized by an arcuate section intermediate the ends thereof, said arcuate section being of concave configuration on the surface facing the opposing arm.

7. In an improved vibrator apparatus adapted to be installed with an intermediate cushioning surface between the apparatus and the user thereof comprising:

a vibrating motor having electrical connection means extending therefrom for insertion into an electrical socket, first and second rigid arm means affixed to the motor and extending therefrom in cantilever fashion in such manner as to receive and transmit vibratory forces from said motor, said arm means arranged in respective planes separated from each other so that each is free to receive vibratory forces perpendicular to said planes from the motor and to transmit such forces along the length thereof, and connecting means affixing the remote ends of said cantilever arms together so that the vibratory force induced into one arm is transmitted to the other arm so as to cause amplification of the vibration thereof, said first and second arm means including an upper arm and a lower arm, each said upper arm and lower arm existing in independent, self-supporting relationship to the other arm and with sufficient distance therebetween as to allow vibrational movement of each without contact with the other, said lower arm being adapted to rest upon a supporting surface and said upper arm being adapted to contact the surface intermediate the apparatus and the person of the user, said upper arm being characterized by an elongate configuration when viewed from the top thereof, and being characterized by an arcuate configuration when viewed from the side thereof, said configuration from the side including a central section of concave arc with respect to the lower arm, said central concave arcuate section defining a static amplitude greater than the static amplitude of the arm on either side thereof, so that a vibratory force introduced to the arm at the supported end vibrates over a greater radial arc in the center of the arm than at either end thereof.

8. The vibrating apparatus of claim 7 wherein the lower arm is defined by a configuration which is the mirror image of the upper arm so that the vibratory forces introduced to the arms at their supported ends are amplified by the central sections thereof and transmitted toward the unsupported end where such forces are transmitted to the opposing arm.

* * * * *